US007845399B2

(12) United States Patent
Sebree

(10) Patent No.: US 7,845,399 B2
(45) Date of Patent: Dec. 7, 2010

(54) DOWNHOLE WELL PUMP

(76) Inventor: Morley Sebree, 4914 - 50 Avenue, Lloydminster, AB (CA) T9V 0W6

( * ) Notice: Subject to any disclaimer, the term of this patent is extended or adjusted under 35 U.S.C. 154(b) by 0 days.

(21) Appl. No.: 12/259,888

(22) Filed: Oct. 28, 2008

(65) Prior Publication Data

US 2010/0101801 A1 Apr. 29, 2010

(51) Int. Cl.
*E21B 43/00* (2006.01)
*E21B 23/00* (2006.01)

(52) U.S. Cl. ..... 166/106; 166/105; 166/179; 166/202

(58) Field of Classification Search ..... 166/179, 166/202, 105, 106
See application file for complete search history.

(56) References Cited

U.S. PATENT DOCUMENTS

| | | | | |
|---|---|---|---|---|
| 209,258 | A | 10/1878 | Hanna | |
| 3,910,730 | A | 10/1975 | Gage | |
| 4,013,387 | A | 3/1977 | Gage | |
| 4,229,149 | A | 10/1980 | Turner | |
| 4,395,204 | A | 7/1983 | Turner | |
| 4,632,647 | A | 12/1986 | Rowlett | |
| 4,951,750 | A * | 8/1990 | Wetzel, Jr. | 166/278 |
| 5,314,025 | A | 5/1994 | Priestly | |
| 5,924,353 | A | 7/1999 | Wang | |
| 6,973,971 | B2 * | 12/2005 | Sebree | 166/311 |
| 2003/0145990 | A1 | 8/2003 | Longacre | |
| 2005/0217866 | A1 * | 10/2005 | Watson et al. | 166/384 |
| 2006/0169458 | A1 | 8/2006 | Jones, Jr. | |

* cited by examiner

*Primary Examiner*—David J Bagnell
*Assistant Examiner*—Yong-Suk Ro
(74) *Attorney, Agent, or Firm*—Bennett Jones LLP

(57) ABSTRACT

An apparatus for use with production tubing to pump fluid from a well to the surface includes a tubular conduit having upper and lower portions. The lower portion has an inner or outer diameter greater than the diameter of the upper portion to form a first internal or external shoulder where the lower and upper portions are engaged. Seals are disposed on the conduit for sealing between the conduit and a well casing. One or more valve sections have a valve adapted to open during downwards motion through fluid and to close during upwards motion through fluid.

11 Claims, 4 Drawing Sheets

DOWNHOLE WELL PUMP

FIELD OF THE INVENTION

This invention relates to an apparatus for pumping fluid from a well to the surface.

BACKGROUND OF THE INVENTION

Within an oil or gas well, production fluids (liquids, gases, or any fluid produced from a wellbore) are produced to the surface within a production string placed in a wellbore. The production string is typically assembled with production tubing and completion components in a configuration that suits the wellbore conditions and the production method. Since oil wells typically vary from a few hundred to several thousands of feet in depth, there is often insufficient pressure to effect the flow of production fluids through the production string out of the well to the surface.

Several prior art systems involving different pumping and extraction devices have been developed to lift production fluids from a well. The most common is a downhole pump installed deep within the well. A surface hydraulic pump pressurizes power oil which drives the downhole pump. When a single production string is used, the power oil is pumped down the tubing and a mixture of the formation crude oil and power oil are produced through the casing-tubing annulus. If two production strings are used, the power oil is pumped through one of the pipes, and the mixture of formation crude oil and power oil are produced in the other, parallel pipe. Prior art artificial lift systems include for example, the progressive cavity pump and plunger lift, both of which are installed on jointed or continuous rods; electric submersible pumps; gear pumps installable on tubing and powered by downhole electric or hydraulic motors; and the Venturi Lift which is run on coiled tubing but is not a total production system. However, such systems tend to be complex or of substantial size and weight, requiring significant structural support elements at the wellhead which increase the expense of the overall system. Therefore, there is a need in the art for an apparatus which mitigates these limitations.

SUMMARY OF THE INVENTION

The present invention relates to an apparatus for pumping fluid from a well to the surface.

In one aspect, the invention provides an apparatus for use with production tubing to pump fluid from a well to the surface comprising:

(a) a tubular conduit comprising an upper portion having an open upper end and a lower portion having an open lower end, the upper portion being releasably engaged to the lower portion, the lower portion having an inner or outer diameter greater than the diameter of the upper portion, forming a first internal or external shoulder where the lower and upper portions are engaged;

(b) sealing means disposed on the tubular conduit for sealing between the conduit and a well casing; and (c) at least one valve section having a one-way valve adapted to allow fluid to pass upward through the valve but not downward, the valve section being adapted to releasably engage either the upper end or the lower end of the conduit.

In one embodiment, the valve section engaging the upper end of the conduit has an external diameter greater than the upper portion, forming a second external shoulder wherein the valve section and the upper portion are engaged.

In one embodiment, the valve section engaging the upper end of the conduit is configured for releasably engaging a lower end of the production tubing. In one embodiment, the valve section releasably engages the lower end of the production tubing by a threaded connection.

In one embodiment, the sealing means engages the upper portion of the conduit and is retained by the first and second shoulders. In one embodiment, the sealing means comprises at least one ring-shaped V cup having an interior diameter substantially equal to the outside diameter of the upper portion. In one embodiment, the sealing means comprises a plurality of V cups.

In one embodiment, the valve section is tubular, having an open upper end and an open lower end and defining a bore extending therethrough between the ends. In one embodiment, the valve section includes a valve at the upper end. In one embodiment, the apparatus has one valve. In one embodiment, the apparatus has two valves. In one embodiment, the valve is selected from a hinged flapper valve or a ball valve. In one embodiment, the apparatus has two hinged flapper valves.

In another aspect, the invention provides a method of pumping fluid from a well to the surface using the above apparatus comprising the steps of:

(a) attaching an upper end of the production tubing to a reciprocating pumping assembly;

(b) attaching the apparatus to a lower end of the production tubing; and (c) reciprocating the production tubing and the attached apparatus until the production fluid is removed from the well for recovery to the surface.

Additional aspects and advantages of the present invention will be apparent in view of the description, which follows. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF PREFERRED EMBODIMENTS

When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

The invention will now be described having reference to the accompanying figures. The apparatus (10) pumps production fluid from a formation to the surface. It will be understood by those skilled in the art that the apparatus (10) is mounted at a lower end of production tubing (12) in a concentric orientation within the well tubulars, for example, the production casing (14) of a conventional gas well, to contact the wellbore fluid. As used herein and in the claims, the term "concentric" refers to components sharing a common center and thus a uniform annular dimension. However, one skilled in the art will recognize that two tubular members where one has a smaller diameter and is placed within the other may be considered concentric, even if they do not share the exact geometric centre, and even if they are not circular in cross-section.

A conventional gas well typically comprises a wellbore extending from the surface through the earth to intersect a production formation to produce natural gas, condensate (i.e., natural gas liquids such as propane and butane) and occasionally water. Similarly, an oil well typically varies from a few hundred to several thousand feet in depth, and there is often insufficient formation pressure to cause the flow of production fluids (i.e., predominantly oil, some gas) to the surface. The apparatus (10) may be placed in vertical, horizontal or inclined wellbores. "Horizontal" means a plane that is substantially parallel to the plane of the horizon. "Vertical" means a plane that is perpendicular to the horizontal plane. Such variations of well design are known to those skilled in the art.

Figure 1:
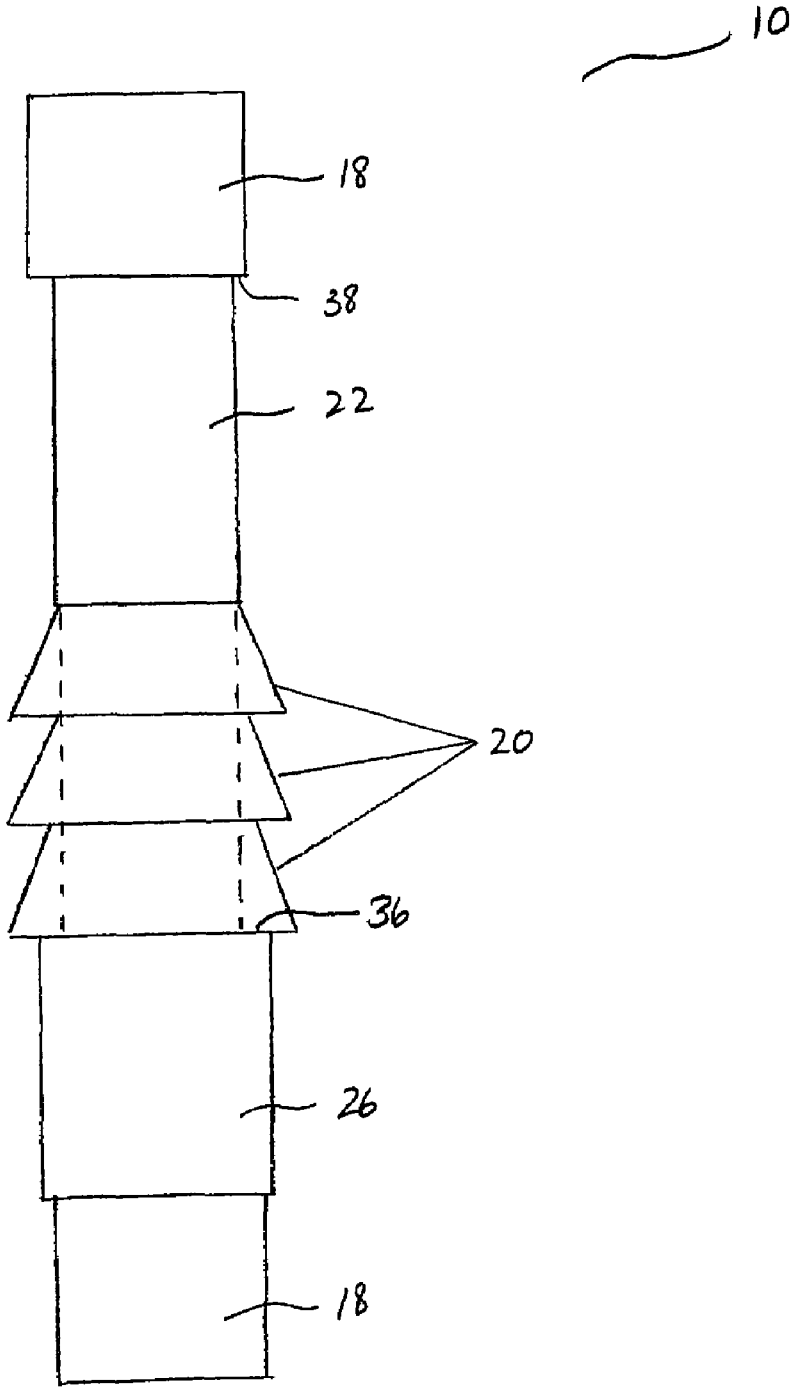
FIG. 1 is a diagrammatic representation of an embodiment of the invention.
Figure 2:
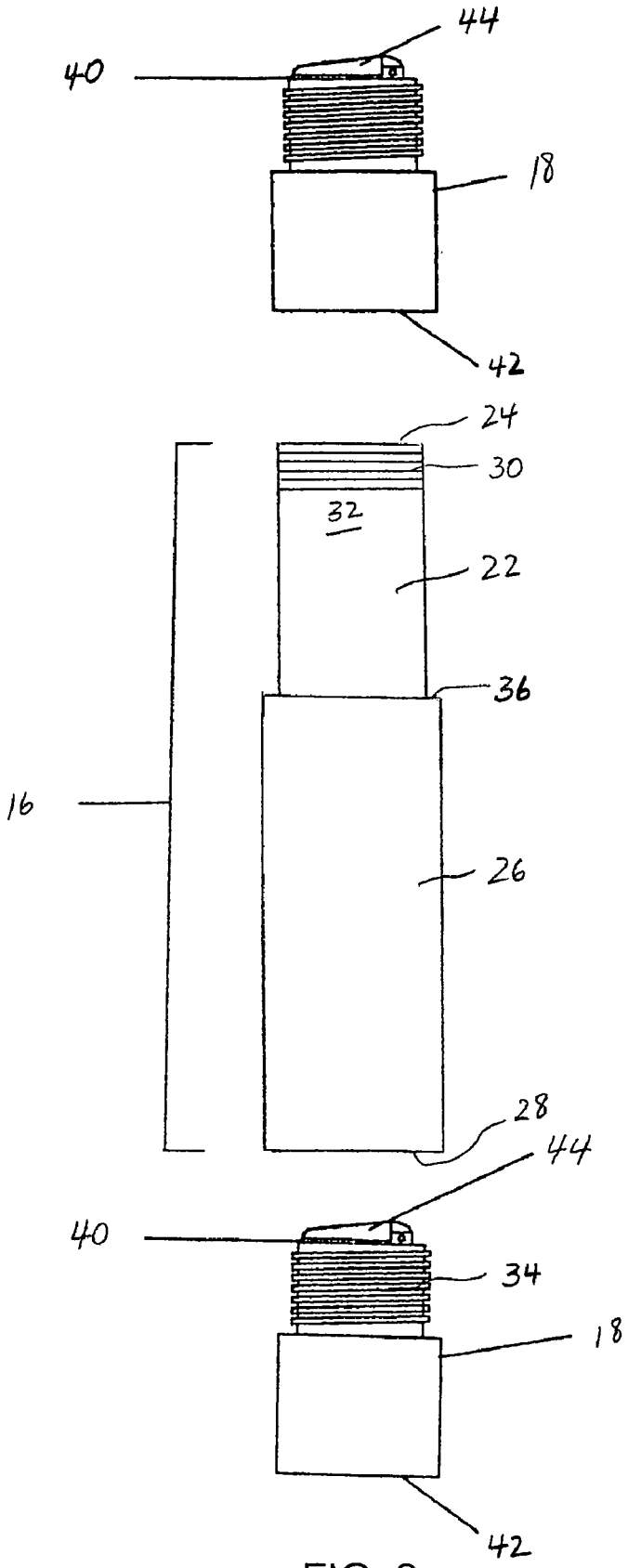
FIG. 2 is an exploded diagrammatic representation of the various components of an embodiment of the invention.

The apparatus (10) is generally shown in FIGS. 1-2 to include a tubular conduit (16), at least one valve section (18), and sealing means (20). The tubular conduit (16) comprises an upper portion (22) having an open upper end (24), and a lower portion (26) having an open lower end (28). The upper end (24) is adapted to releasably engage a first valve section (18). The upper end (24) may have threads (30) on its outer wall (32) to attach to mating threads of the inner wall (not shown) of the first valve section (18). The lower end (28) is adapted to engage a second valve section (18). The lower end (28) may have threads on its inner wall (not shown) to attach to mating threads (34) of the second valve section (18). Suitable engagement means other than threaded connections are well known to those skilled in the art.

The lower portion (26) has an inner or outer diameter greater than the diameter of the upper portion (22), forming a first internal or external shoulder (36) at the junction of the lower and upper portions (26, 22). The first valve section (18) to which the upper portion (22) is connected has an external diameter greater than the upper portion (22), forming a second external shoulder (38) at the junction of the first valve section (18) and upper portion (22). Suitable engagement means known in the art such as, for example, threaded connections, may be used to connect the upper and lower portions (22, 26).

The sealing means (20) is placed on the upper portion (22), with its longitudinal movement restricted to the length of the upper portion (22) located between the first and second shoulders (36, 38). The first shoulder (36) acts as a physical barrier to prevent the sealing means (20) from slipping off the lower end (28) of the conduit (16) on the upstroke of the apparatus (10). The second shoulder (38) acts as a physical barrier to prevent the sealing means (20) from slipping off the upper end (24) of the upper portion (22) on the downstroke of the apparatus (10).

The sealing means (20) is sized so as to seal between the conduit (16) and the well casing (14). Suitable sealing means (20) as are known in the art may be used. The sealing means (20) may be formed of, for example, synthetic rubbers, thermoplastic materials, perfluoroelastomer materials, or other suitable substances known to those skilled in the art. Appropriate sealing means (20) are sufficiently resilient for providing a good seal and sufficiently rigid for providing a relatively long life therefore. The dimensions of the sealing means (20) are not essential to the invention and are dictated by the size of the production tubing (12) and well casing (14).

Figure 3:
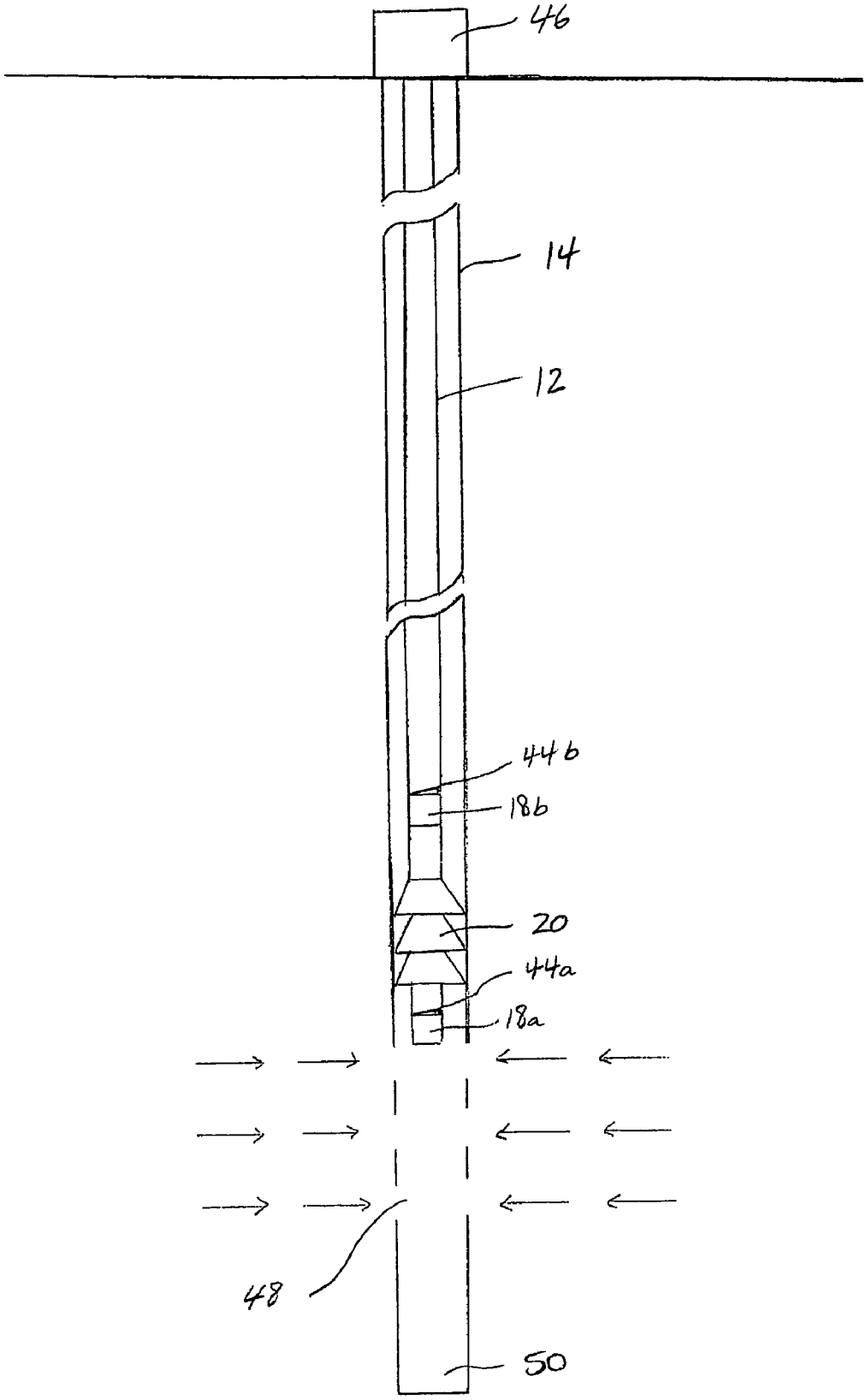
FIG. 3 is a diagrammatic representation of an embodiment of the invention during upstroke of the apparatus, showing the valves in a closed position.
Figure 4:
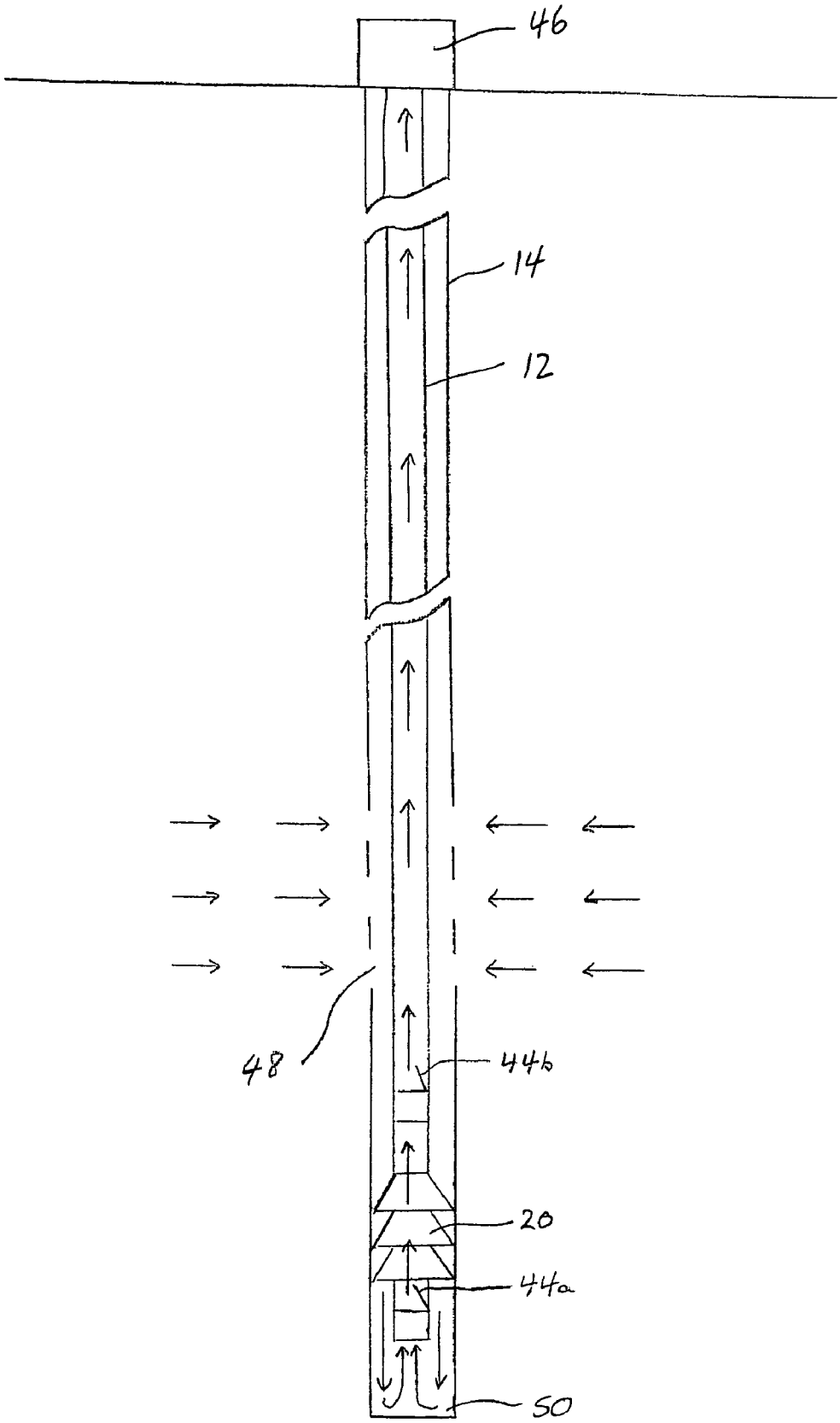
FIG. 4 is a diagrammatic representation of an embodiment of the invention during downstroke of the apparatus, showing the valves in an open position.

In one embodiment, the sealing means (20) may comprise one or more ring-shaped V cups, with each having an inner diameter substantially equal to the outside diameter of the upper portion (22). The outer diameter of the V cup (20) is substantially equal to the diameter of the well casing (14). The V cup (20) is a resiliently flexible disk shaped body having a central hole. The diameter of the central hole is substantially equal to the outer diameter of the upper portion (22) such that the V cup (20) is placed onto the upper portion (22) in a collar-like manner. The walls of the V cup (20) extend radially from the central hole at an angle below the horizontal plane of the central hole such that the outer edge of the cup terminates at a position below the plane of the central hole. The V cup (20) is orientated so that the cup walls extend radially towards the lower portion (26). The V cup (20) may be made of rubber or any other suitable resiliently flexible material. When more than one V cup (20) is used, the V cups (20) are oriented in a stacked relationship over the upper portion (22), as shown in FIGS. 1, 3 and 4.

Each valve section (18) is tubular, having an open upper end (40) and an open lower end (42) and defining a bore (not shown) extending therethrough between its ends (40, 42). The valve section (18) includes a valve (44) at the upper end (40). The valve (44) is one-way, allowing fluid to pass upward through the valve but not downward. The valve (44) is thus configured to open during downwards motion through fluid, and to close during upwards motion through liquid. In one embodiment, the apparatus (10) has one valve (44). In one embodiment, the apparatus (10) has two valves (44). The presence of two valves (44) minimizes the risk of valve failure in the event for example, that one valve becomes worn or damaged. In one embodiment, the valve (44) is selected from a hinged flapper valve or a ball valve. In one embodiment, the apparatus (10) has two hinged flapper valves. Hinged flapper valves are less susceptible to wear, and allow the passage of large volumes of sand, debris and solid particulate matter. It will be understood by those skilled in the art that other suitable valves may be used, interchanged or selected in accordance with the type of fluid being pumped; for example, a flapper valve may be used with heavy oil and sand, while a ball valve may be used with lighter fluids and in the absence of solid particulate material.

The apparatus (10) can be constructed from any material or combination of materials having suitable properties such as, for example, mechanical strength, ability to withstand cold and adverse field conditions, corrosion resistance, and ease of machining. In one embodiment, the conduit (16) and valve sections (18) are formed of steel or stainless steel.

As shown in the Figures, the apparatus (10) may be formed from the assembly of separate components. However, those skilled in the art will understand that various modifications can be made without altering the substance of the invention. For example, the upper and lower portions (22, 26) may be manufactured as a monolithic unit.

During installation, the apparatus (10) may be assembled at the surface with the components attached in sequence; for example, the second valve section (18) is connected to the lower portion (26). The upper portion (22) is attached to the lower portion (26) over which the sealing means (20) is slid to rest against the first shoulder (36). The second valve section (18) is attached to the upper portion (22). The fully assembled apparatus (10) is then connected to the lower end of the production tubing (12). The apparatus (10) may also be assembled with each component being individually attached in sequence to the lower end of the production tubing (12); for example, the first valve section (18*b*), upper portion (22), sealing means (20), lower portion (26), and the second valve section (18*a*). With the assistance of a conventional service rig, the production tubing (12) and apparatus (10) are deployed into the wellbore until reaching the desired zone as will be described.

The operation of pumps is commonly known to those skilled in the art and will not be discussed in detail. Pumping strings are well known in the art and are attached to the production tubing (12) to reciprocate the apparatus (10). Conventional machinery such as, for example, a pump jack or driver (46), is used to raise and lower the pumping string in order to effect alternating upstrokes and downstrokes of the apparatus (10). The conduits defined by the pumping string (not shown), production tubing (12) and apparatus (10) define a fluid flow passage which extends from the wellbore to the surface in order to deliver the pumped fluid to the surface.

In another aspect, the invention provides a method of pumping fluid from a well to the surface using the above apparatus comprising the steps of attaching an upper end of the production tubing to a reciprocating pumping assembly; attaching the apparatus to a lower end of the production tubing; and reciprocating the production tubing and the attached apparatus until the production fluid is removed from the well for recovery to the surface.

In operation, the pumping string is driven by conventional machinery to effect upstrokes and downstrokes of the apparatus (10). During each upstroke, the apparatus (10) is raised above a plurality of perforations (48) which are diametrically opposed and spaced intermittently along the closed casing (14), as shown in FIG. 3. Both the valves (44*a*, 44*b*) and the sealing means (20) are thus raised above the perforations (48). The valves (44*a*, 44*b*) are in the closed position. The sealing means (20) is in a sealing engagement with the casing (14). The upwards vertical movement of the apparatus (10) allows the sealing means (20) to create a suctioning force which draws production fluids from the formation through the perforations (48) into the casing (14). The valves (44*a*, 44*b*) of the valve sections (18*a*, 18*b*) close during the upstroke. Upon completion of the upstroke, the lower annulus (50) of the casing (14) is replete with production fluid to be produced from the well.

During each downstroke, the apparatus (10) is lowered past the perforations (48), as shown in FIG. 4. Both the valves (44*a*, 44*b*) and sealing means (20) are thus driven below the perforations (48). The valves (44*a*, 44*b*) are in the open position. The sealing means (20) is in a sealing engagement with the casing (14). The downwards vertical movement of the apparatus (10) enables the sealing means (20) to apply a compressive force to the production fluid in the lower annulus (50) of the casing (14), pushing the fluid upwardly through the lower valve section (18*a*). The upwards motion of the fluid opens the valve (44*a*) to pass into the conduit (16) and into the upper valve section (18*b*). The continued upwards motion of the fluid opens the upper valve (44*b*) to pass into the production tubing (12) to the surface.

Upon completion of the downstroke, the apparatus (10) is positioned at the bottom of the casing (14), and then is raised upwardly during the next upstroke. As the upstroke is initiated, the compressive force is removed from below the perforations (48), and the valves (44*a*, 44*b*) return to their closed positions. The valves (44*a*, 44*b*) remain closed throughout the upstroke of the apparatus (10). As the sealing means (20) moves upwardly past the perforations (48), production fluid from the formation is drawn into the lower annulus (50) of the casing (14). Alternating upstrokes and downstrokes of the apparatus (10) are repeated within the well until the production fluid has been removed from the formation and pumped for recovery at the surface.

In the event the sealing means (20) becomes worn or is otherwise damaged during operation, the valve section (18*b*) may be easily removed from the upper portion (22) by unthreading their connection, whereupon replacement sealing means (20) may be installed over the upper portion (22), and a continued efficient operation of the apparatus (10) will be provided.

The apparatus (10) pumps production fluids from a formation into a well and then to the surface. Importantly, the apparatus (10) is simple and efficient in operation. The valves (44*a*, 44*b*) of the apparatus (10) may be interchanged or selected in accordance with the type of fluid being pumped. Support of the apparatus (10) by the production tubing (12) eliminates the requirement for anchoring means within the well. The apparatus (10) or components thereof (for example, the valve sections (18*a*, 18*b*) and sealing means (20)) can be readily assembled, or unassembled for inspection, reinsertion or replacement if necessary in a minimum of time and effort, thus reducing the cost of operation of the apparatus (10). Further, the apparatus (10) requires few components, thereby eliminating the requirement for complex, downhole moving parts and minimizing expense in manufacturing. Conveniently, unassembled components of the apparatus (10) can be stored and carried in a small tool box for assembly on the servicing rig, eliminating the expense of equipment transport and rig jobs.

As will be apparent to those skilled in the art, various modifications, adaptations and variations of the foregoing specific disclosure can be made without departing from the scope of the invention claimed herein.

What is claimed is:

1. An apparatus for use with production tubing to pump fluid from a well to the surface comprising:

(a) a tubular conduit comprising an upper portion having an open upper end and a lower portion having an open lower end, the upper portion being releasably engaged to the lower portion, the lower portion having an inner or outer diameter greater than the diameter of the upper portion, forming a first internal or external shoulder where the lower and upper portions are engaged;

(b) first and second valve sections, each having a one-way valve adapted to allow fluid to pass upward through the valve but not downward, the first valve section being adapted to releasably engage the upper end of the conduit and the second valve section being adapted to releasably engage the lower end of the conduit; and (c) sealing means disposed on the tubular conduit for sealing between the conduit and a well casing comprising at least one ring-shaped V cup having an interior diameter substantially equal to the outside diameter of the upper portion, and oriented such that the cup extends radially outwards and downwards towards the second valve section.

2. The apparatus of claim 1, wherein the valve section engaging the upper end of the conduit has an external diameter greater than the upper portion, forming a second external shoulder wherein the valve section and the upper portion are engaged.

3. The apparatus of claim 2, wherein the valve section engaging the upper end of the conduit is configured for releasably engaging a lower end of the production tubing.

4. The apparatus of claim 3, wherein the valve section releasably engages the lower end of the production tubing by a threaded connection.

5. The apparatus of claim 2, wherein the sealing means engages the upper portion of the conduit and is retained by the first and second shoulders.

6. The apparatus of claim 1, wherein the sealing means comprises a plurality of V cups.

7. The apparatus of claim 1, wherein the valve section is tubular, having an open upper end and an open lower end and defining a bore extending therethrough between the ends.

8. The apparatus of claim 7, wherein the valve section includes a valve at the upper end.

9. The apparatus of claim 1, wherein the valve is selected from a hinged flapper valve or a ball valve.

10. The apparatus of claim 1, having two hinged flapper valves.

11. A method of pumping fluid from a well to the surface using the apparatus of claim 1 comprising the steps of:

(a) attaching an upper end of the production tubing to a reciprocating pumping assembly;

(b) attaching the apparatus to a lower end of the production tubing; and (c) reciprocating the production tubing and the attached apparatus continuously above and below well perforations until the production fluid is removed from the well for recovery to the surface.

* * * * *